US010739709B2

(12) United States Patent
Nakagawa

(10) Patent No.: US 10,739,709 B2
(45) Date of Patent: Aug. 11, 2020

(54) FIXING DEVICE AND IMAGE FORMING APPARATUS

(71) Applicant: KYOCERA Document Solutions Inc., Osaka (JP)

(72) Inventor: Takafumi Nakagawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/531,805

(22) Filed: Aug. 5, 2019

(65) Prior Publication Data

US 2020/0057405 A1 Feb. 20, 2020

(30) Foreign Application Priority Data

Aug. 17, 2018 (JP) ..... 2018-153654

(51) Int. Cl.
*G03G 15/20* (2006.01)
*G03G 15/00* (2006.01)

(52) U.S. Cl.
CPC ..... *G03G 15/2028* (2013.01); *G03G 15/2064* (2013.01)

(58) Field of Classification Search
CPC ..... G03G 15/2028; G03G 15/2064
See application file for complete search history.

(56) References Cited

U.S. PATENT DOCUMENTS

2006/0159489 A1* 7/2006 Ishii ..... G03G 15/2014 399/165
2013/0064587 A1* 3/2013 Jeong ..... G03G 15/2039 399/329

FOREIGN PATENT DOCUMENTS

JP 2011-022473 A 2/2011

* cited by examiner

*Primary Examiner* — Clayton E. LaBalle
*Assistant Examiner* — Michael A Harrison
(74) *Attorney, Agent, or Firm* — Studebaker & Brackett PC

(57) ABSTRACT

A fixing device includes a fixing belt, a pressuring member, a supporting member arranged inside the fixing belt, a nip forming member, a cap supporting an end of the fixing belt and a pivot supporting member. The nip forming member attached to the supporting member sandwiches the fixing belt with the pressuring member. The pivot supporting member attached at an end of the supporting member pivotally supports the cap. The pivot supporting member includes a positioning member fitted on the supporting member from an end side and locked to the supporting member at a center side, and a fastening member fitted on the supporting member and the positioning member and fastened to the supporting member. The positioning member and the fastening member fitted to each other constitute the outer face of the pivot supporting member along an inner face of the cap.

16 Claims, 11 Drawing Sheets

FIXING DEVICE AND IMAGE FORMING APPARATUS

INCORPORATION BY REFERENCE

This application is based on and claims the benefit of priority from Japanese Patent application No. 2018-153654 filed on Aug. 17, 2018, the entire contents of which are incorporated herein by reference.

BACKGROUND

The present disclosure relates to a fixing device fixing a toner image on a sheet and an image forming apparatus including this fixing device.

An image forming apparatus includes a fixing device fixing a toner image formed on a sheet. The fixing device includes a fixing member heating the toner image formed on the sheet, and a pressuring member pressuring the toner image to the sheet. The fixing device applies, for example, a fixing belt as the fixing member and, inside the fixing belt, a nip forming member sandwiching the fixing belt together with the pressuring member to form a fixing nip between the fixing belt and the pressuring member and a supporting member being anchored to a fixing frame and supporting the nip forming member are provided.

For example, a conventional fixing device includes a belt member provided circulation-movably, a pressing member coming into contact with an outer circumference face of the belt member to press the belt to an inner side, a receiving member arranged so as to come into contact with an inner circumference face of the belt member to receive pressing force from the pressing member, and a supporting part supporting the receiving member. The supporting part has one end at an upstream side in moving direction of the belt member and the other end at a downstream side in the moving direction, is arranged so as to face to the receiving member, and includes a first piece receiving a load from the receiving member. The supporting part includes a second piece connected to a one end side of the first piece to go to in a separating direction from the receiving member, and a third piece connected to the other end side of the first piece to go to in a separating direction from the receiving member. The supporting part includes a fourth piece arranged so as to have a gap between the first piece and the fourth piece and connected to the second piece and the third piece. The supporting part includes an anchored member anchored to the first piece and the fourth piece and having a portion arranged between the second piece and the third piece.

In the fixing device, the supporting member receives pressuring force from the pressuring member via the nip forming member. If the supporting member is deformed by the pressuring force, because pressure distribution brought to the fixing nip by the nip forming member becomes uneven, the supporting member needs to be made with sufficient strength. If the supporting member is made of wide sheet metal in order to improve strength of the supporting member, it is necessary to sure a large space for anchoring the supporting member to the fixing frame and size of the other members located around the supporting member is restricted. Moreover, if the supporting member is made by bending the sheet metal multiple times in order to improve strength of the supporting member, it is difficult to accurately form an attached face of the supporting member on which the nip forming member is attached. If the inaccurate nip forming member is attached to an inaccurate attached face, pressure distribution of the fixing nip becomes uneven.

Incidentally, in the fixing device, the fixing belt is rotatably attached to the supporting member. For example, caps are attached to both ends of the fixing belt and pivot supporting members pivotally supporting the caps rotatably are attached at both ends of the supporting member. The pivot supporting members need to be positioned to the supporting member in a rotating direction and a circumference direction of the fixing belt, and to be fastened to the supporting member. However, because the supporting member cannot apply much processing on the reason of strength improvement, a shape of the pivot supporting member is restricted according to a shape of the supporting member.

SUMMARY

In accordance with an embodiment of the present disclosure, a fixing device includes a rotatable fixing belt, a rotatable pressuring member, a supporting member, a nip forming member, a cap and a pivot supporting member. The fixing belt heats a toner image formed on a sheet. The pressuring member is pressured to the fixing belt to pressure the sheet passing between the fixing belt and the pressuring member. The supporting member is arranged inside the fixing belt to support the fixing belt rotatably. The nip forming member is attached to the supporting member inside the fixing belt to form a fixing nip between the fixing belt and the pressuring member by sandwiching the fixing belt together with the pressuring member. The cap supports an end in a rotation axis direction of the fixing belt. The pivot supporting member is attached at an end of the supporting member in the rotation axis direction to have an outer circumference face along an inner circumference face of the cap and to pivotally support the cap rotatably. The pivot supporting member includes a positioning member fitted on the supporting member along an outer circumference face of the supporting member from an end side in the rotation axis direction and locked to the supporting member at a center side in the rotation axis direction, and a fastening member fitted on the supporting member and the positioning member and fastened to the supporting member. The positioning member and the fastening member constitute the outer circumference face of the pivot supporting member along the inner circumference face of the cap in a state that the positioning member and the fastening member are fitted to each other.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
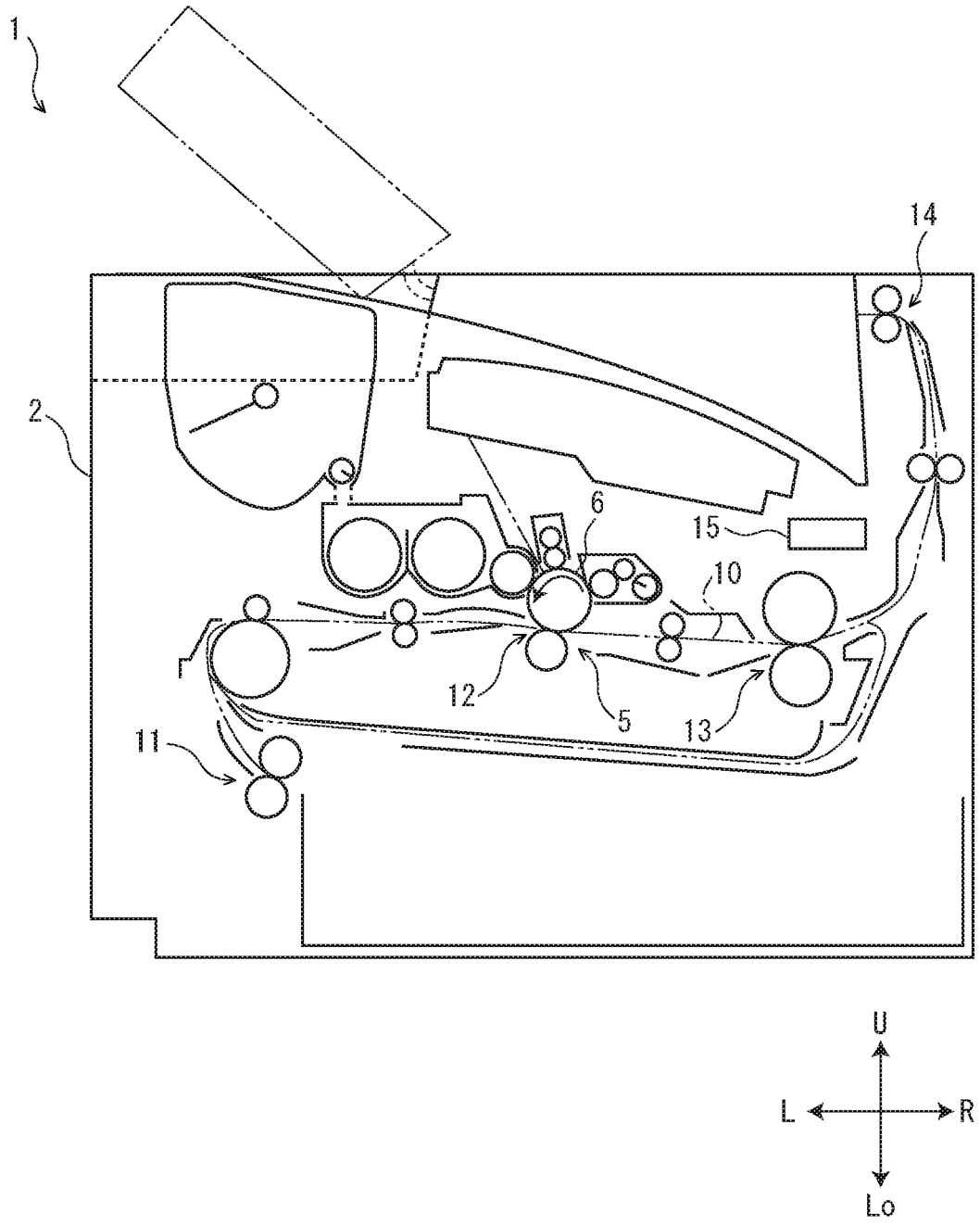
FIG. 1 is a sectional view schematically showing a printer according to an embodiment of the present disclosure.

First, with reference to FIG. 1, the entire structure of a printer 1 (an image forming apparatus) will be described. Hereinafter, it will be described so that the front side of the printer 1 is positioned at a near side on a paper sheet of FIG. 1. Arrows L, R, U, Lo, Fr and Rr in each of the drawings respectively indicate a left side, a right side, an upper side, a lower side, a front side and a rear side of the printer 1.

The printer 1 includes a roughly box-like formed printer body 2. In a lower part of the printer body 2, a sheet feeding cartridge storing sheets is installed. In an upper face of the printer body 2, an ejected sheet tray is formed.

In an upper part inside the printer body 2, an exposure device composed of a laser scanning unit (LSU) is located below the ejected sheet tray. Inside the printer body 2 and below the exposure device, an image forming part 5 is arranged. In the image forming part 5, a photosensitive drum 6 as an image carrier is rotatably arranged. Around the photosensitive drum 6, a charging device, a development device connected to a toner container, a transfer roller and a cleaning device are located along a rotating direction of the photosensitive drum 6.

Inside the printer body 2, a conveying path 10 for the sheet is arranged. At an upstream end of the conveying path 10, a sheet feeding part 11 is positioned near the sheet feeding cartridge. At an intermediate stream part of the conveying path 10, a transferring part 12 composed of the photosensitive drum 6 and the transfer roller is positioned. At a downstream part of the conveying path 10, a fixing device 13 is positioned. At a downstream end of the conveying path 10, a sheet ejecting part 14 is positioned near the ejected sheet tray. In addition, inside the printer body 2, a controlling device 15 controlling the fixing device 13 is provided. The controlling device 15 is composed of a control circuit, such as a CPU, and storage, such as a ROM and a RAM.

Next, image forming operation of the printer 1 will be described. In the printer 1, when image data is inputted and a printing start is directed from an external computer or the like connected with the printer 1, image forming operation is started. In image forming operation, first, the surface of the photosensitive drum 6 is electrically charged by the charging device of the image forming part 5, and then, is exposed on the basis of the image data by the exposure device, thereby forming an electrostatic latent image on the surface of the photosensitive drum 6. Subsequently, the electrostatic latent image is developed to a toner image by using a toner in the development device of the image forming part 5.

On the other hand, the sheet stored in the sheet feeding cartridge is picked up by the sheet feeding part 11 and conveyed on the conveying path 10. The sheet on the conveying path 10 is conveyed to the transferring part 12 in a given timing and the toner image on the photosensitive drum 6 is transferred on the sheet by the transferring part 12. The sheet with the transferred toner image is conveyed to the fixing device 13 and the toner image is fixed on the sheet by the fixing device 13. The sheet with the fixed toner image is ejected from the sheet ejecting part 14 to the sheet ejected tray.

Figure 2:
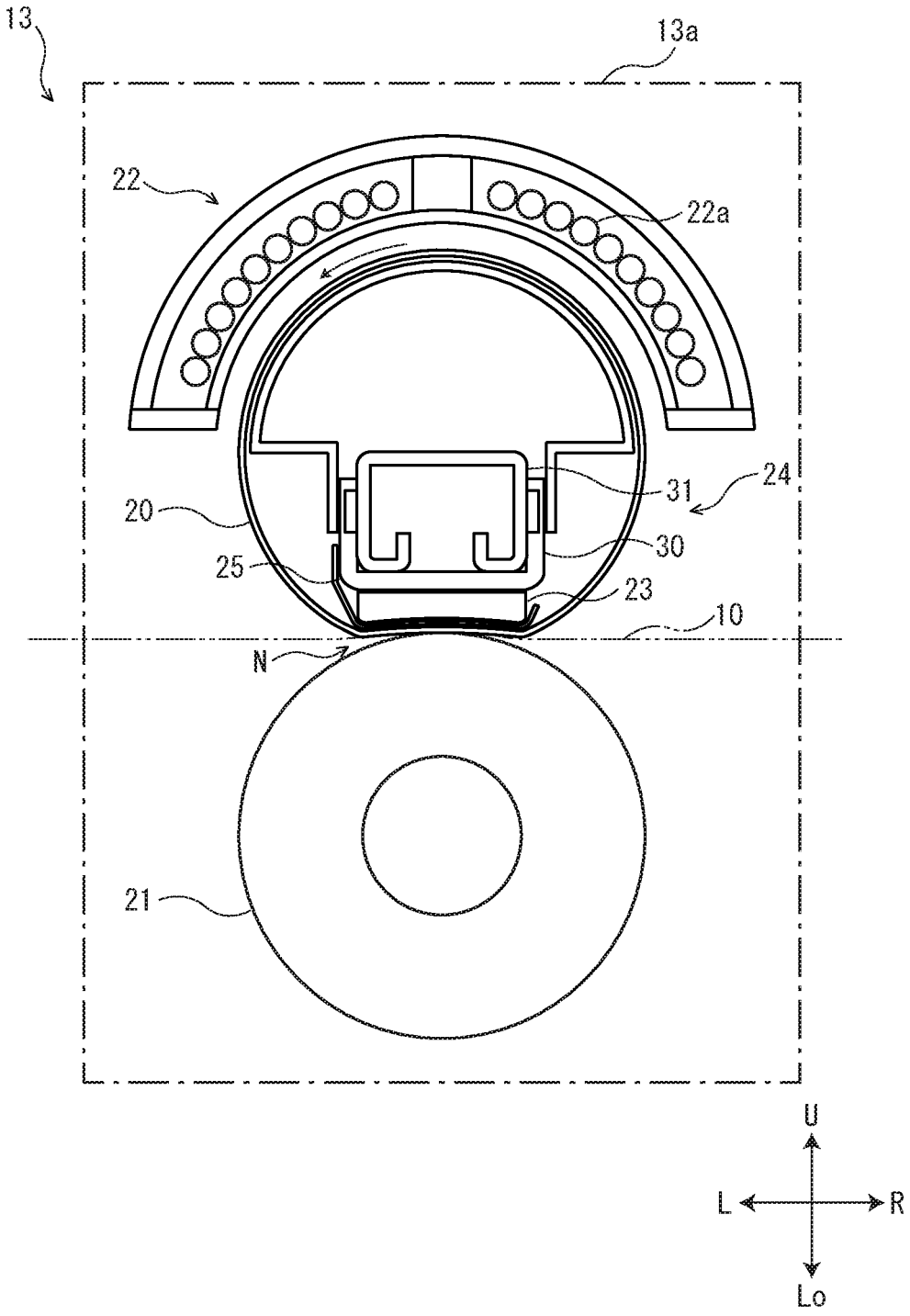
FIG. 2 is a sectional view showing a fixing device according to the embodiment of the present disclosure.

Next, a configuration of the fixing device 13 will be described with reference to FIG. 2 to FIG. 11. As shown in FIG. 2, the fixing device 13 includes a fixing belt 20, a pressuring roller 21 (a pressuring member), a heat source 22, a pad 23 (a nip forming member) and a supporting member 24.

The fixing belt 20 and the pressuring roller 21 are respectively arranged at an upper side and lower side across the conveying path 10 inside a roughly box-like formed fixing frame 13*a* so as to face to each other and to come into contact with each other. The fixing frame 13*a* is attached to the printer body 2 so that the conveying path 10 penetrates the fixing frame 13*a* in a conveying direction (left and right directions) of the sheet. In the conveying path 10, a fixing nip N of a predetermined pressuring area is formed between the fixing belt 20 and the pressuring roller 21.

Incidentally, the pressuring area N is an area in which the fixing belt 20 and the pressuring roller 21 come into contact with each other. The pressuring area N indicates an area within a range from an upstream side position where the pressure of the fixing belt 20 and the pressuring roller 21 to the sheet is 0 Pa to a downstream side position where the pressure is 0 Pa again via a position where the pressure is a maximum.

The fixing belt 21 is an endless belt having flexibility and is formed in a cylindrical shape elongated (having a long side) in a width direction (forward and backward directions) of the sheet orthogonal (cross) to in the conveying direction (left and right directions) of the sheet. For example, the fixing belt 21 is composed of a heated layer, an elastic layer provided around the heated layer and a release layer covering the elastic layer. The heated layer is made of metal material, such as nickel electroformed material, the elastic layer is made of elastic material, such as a silicone rubber and the release layer is made of fluorine-based resin material, such as PFA (Perfluoro alkoxy alkane). Incidentally, on an inner circumference face of the fixing belt 20, a heat resistant resin coat, such as PTFE (Poly Tetra Fluoro Ethylene) is provided.

The fixing belt 20 is attached rotatable to the fixing frame 13*a* around a rotation axis direction as the width direction to rotate by following rotation of the pressuring roller 21. A lower side portion (a portion at a side of the pad 23) of the fixing belt 20 is shaped along a shape of the pad 23. The fixing belt 20 is heated by the heat source 22, for example, the heated layer of the fixing belt 20 is induction-heated by a magnetic flux generated from the heat source 22 to come into contact with the sheet with the formed toner image and to heat the toner image.

The pressuring roller 21 is formed in a columnar shape elongated (having a long side) in the width direction of the sheet. For example, the pressuring roller 21 is composed of a columnar core material made of metal, an elastic layer made of resin, such as a silicone rubber, provided around the core material, and a release layer made of fluorine-based resin, such as PFA, covering the elastic layer.

The pressuring roller 21 is attached rotatable to the fixing frame 13*a* around a rotation axis direction as the width direction. For example, the core material of the pressuring roller 21 is connected by a drive source (not shown), such as a motor, and rotated by rotation drive force transmitted from the drive source, and thereby, the pressuring roller 21 is rotated. Moreover, the pressuring roller 21 is pressured to a side of the fixing belt 20 by predetermined pressuring force to form the fixing nip N between the fixing belt 20 and the pressuring roller 21 and to pressure the sheet passing through the fixing nip N together with the fixing belt 20.

The heat source 22 is configured to heat the fixing belt 20 over the width direction, for example, composed of an IH (Induction Heating) fixing unit including a coil 22*a*. The heat source 22 is formed so as to have a long side in the width direction, to have an arched cross section and to cover the fixing belt 20, and located outside (above) the fixing belt 20. In other words, the heat source 22 is located at an opposite side to the pressuring roller 21 across the fixing belt 20 at a predetermined interval from the fixing belt 20.

The heat source 22 as the IH fixing unit is controlled by the controlling device 15 to apply electric power supplied from a power source (not shown) to the coil 22*a*, and then, electric current is flowed in the coil 22*a* and the magnetic flux penetrating the coil 22*a* is generated. The heat source 22 makes the magnetic flux produced in the coil 22*a* act on the fixing belt 20 to induction-heat the fixing belt 20 (the heated layer). The coil 22*a* is, for example, an external covering coil wound so as to reciprocally run along the rotation axis direction and shaped along a curved face (outer circumference face) shape of the fixing belt 20. Incidentally, the controlling device 15 controls electric power supply to the heat source 22 so that surface temperature of the fixing belt 20 detected by a temperature sensor (not shown) becomes predetermined fixing temperature.

The pad 23 is a longitudinal member, for example, made of heat resistant resin material, such as LCP (Liquid Crystal Polymer), and having a longitudinal direction as the rotation axis direction of the fixing belt 20 and a lateral direction as a nip width direction orthogonal (cross) to the rotation axis direction. The pad 23 is attached at a side of the pressuring roller 21 (a lower side) from the supporting member 24 inside the fixing belt 20 and at an approximate position and an approximate direction with respect to the pressuring roller 21 by the supporting member 24.

Moreover, the pad 23 is located so that a face of the pad 23 at the side of the pressuring roller 21 (a lower side), i.e. a pressing face comes into contact with the inner circumference face of the fixing belt 20 via a sliding sheet 25. The pad 23 receives the pressuring force from the pressuring roller 21 via the fixing belt 20 and presses the pressuring roller 21 via the fixing belt 20 against the pressuring force. Thereby, the pad 23 sandwiches the fixing belt 20 together with the pressuring roller 21 to form the fixing nip N between the fixing belt 20 and the pressuring roller 21.

Figure 3:
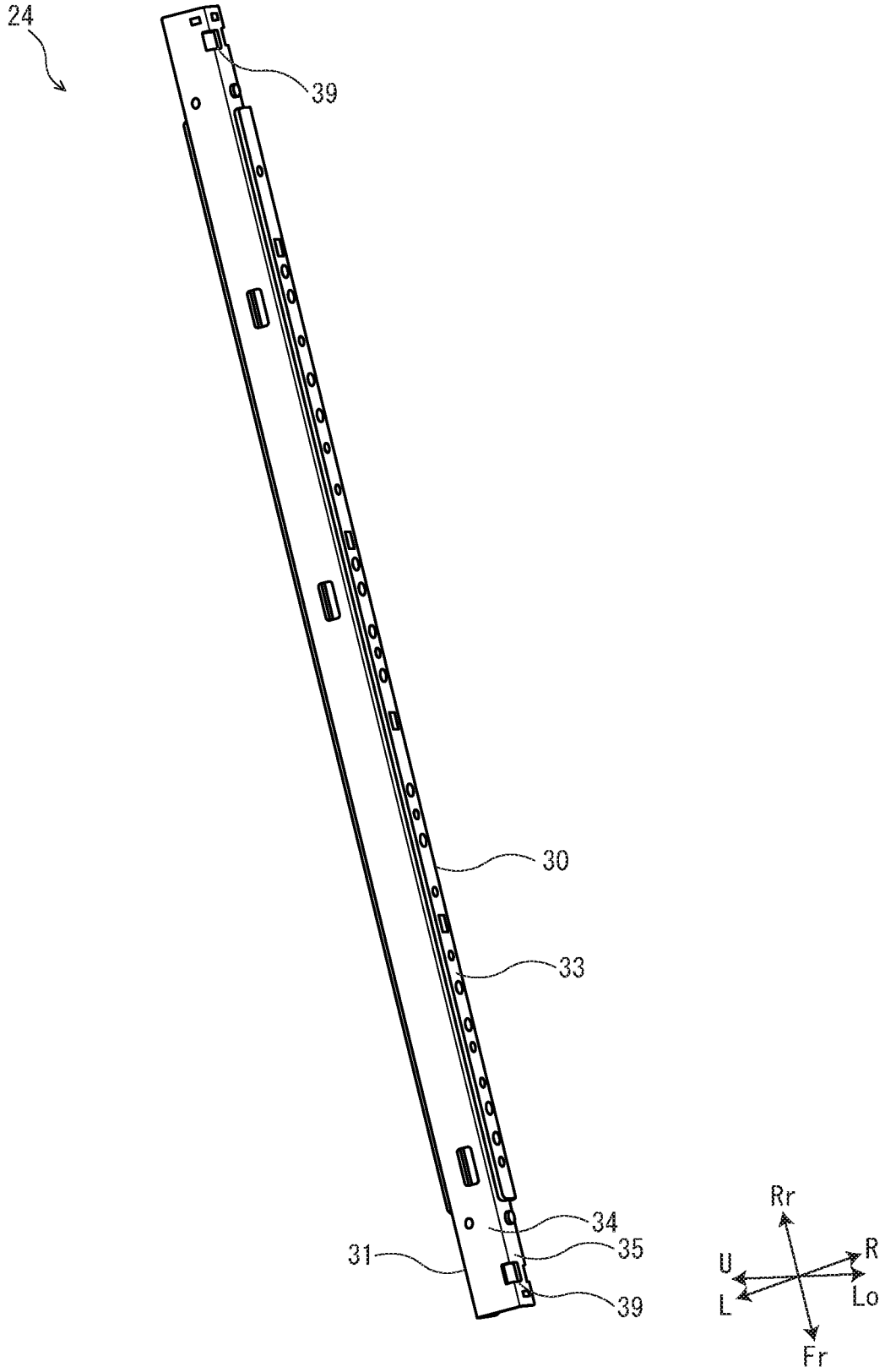
FIG. 3 is a perspective view showing a supporting member as viewed from an upper side in the fixing device according to the embodiment of the present disclosure.
Figure 4:
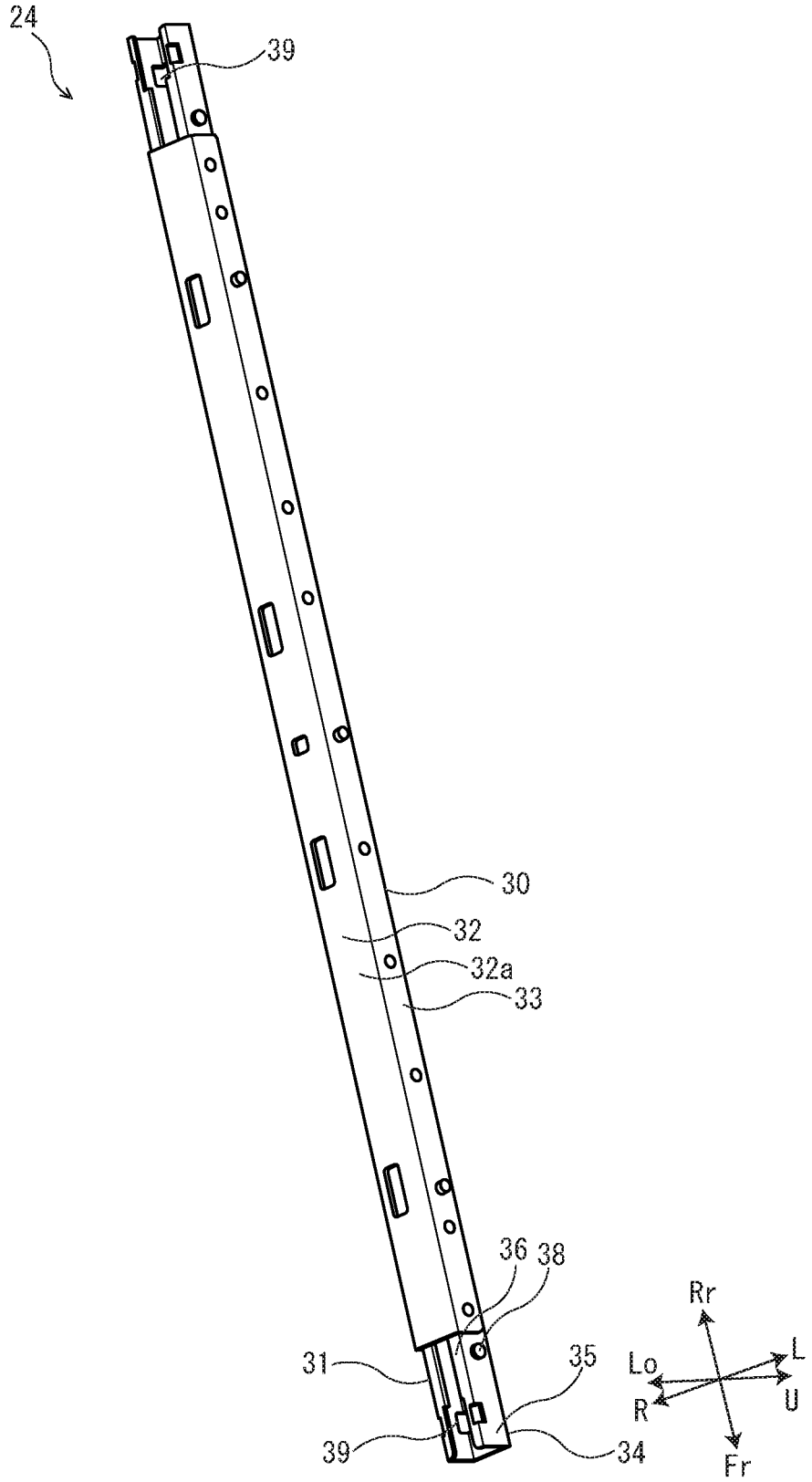
FIG. 4 is a perspective view showing the supporting member as viewed from a lower side in the fixing device according to the embodiment of the present disclosure.
Figure 5:
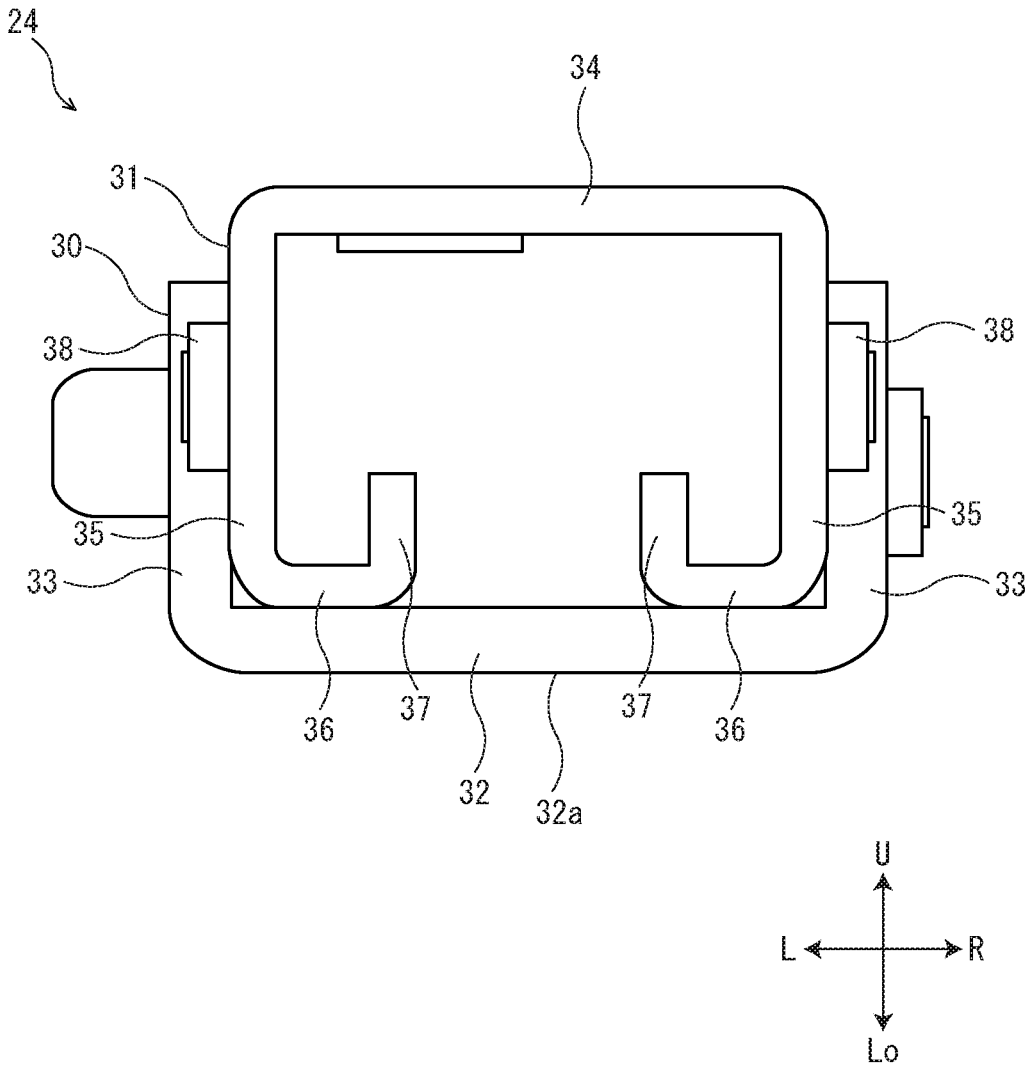
FIG. 5 is a front view showing the supporting member in the fixing device according to the embodiment of the present disclosure.

The supporting member 24 is made of metal material, as shown in FIGS. 3 and 4, formed in a rectangular tubular shape elongated (having a long side) in the rotation axis direction of the fixing belt 20, and located at a roughly center inside the fixing belt 20. Both ends in a longitudinal direction of the supporting member 24 are protruded outside the fixing belt 20 and supported by the fixing frame 13*a*. The supporting member 24 supports the fixing belt 20 rotatably and supports the pad 23 and other components inside the fixing belt 20. For example, the supporting member 24 supports a belt guide supporting a cylindrical shape of the fixing belt 20 from the inside and the sliding sheet 25 interposed between the fixing belt 20 and the pad 23 to improve slidability of the fixing belt 20. Because the supporting member 24 receives the pressuring force from the pressuring roller 21 via the fixing belt 20 and the pad 23, the supporting member 24 is made of material and shape achieving high mechanical strength.

The supporting member 24 is configured, as shown in FIGS. 2-5, by combining individual components of a first sheet metal 30 on which the pad 23 is attached and a second sheet metal 31 attached to the fixing frame 13*a*. The first sheet metal 30 and the second sheet metal 31 are respectively elongated (having long sides) in the rotation axis direction of the fixing belt 20, and formed to have roughly U-shape cross sections, i.e. formed to have opening faces. The opening faces of the first sheet metal 30 and the second sheet metal 31 are mutually matched and the second sheet metal 31 is fitted into the inside of the first sheet metal 30, and thereby, the rectangular tubular shape of the supporting member 24 is constructed.

The first sheet metal 30 has roughly the same length as the fixing belt 20 and the pad 23 in the rotation axis direction, and is attached to the second sheet metal 31. The first sheet metal 30 is formed integrally to have an attachment part 32 as a bottom portion of the U-shape elongated in the conveying direction and a pair of first wall parts 33 bent from both ends of the attachment part 32. The first sheet metal 30 is located so that the attachment part 32 is positioned at a lower side, and the attachment part 32 becomes a lower plate of the supporting member 24 and a lower face of the attachment part 32 becomes an attachment face 32*a* on which the pad 23 is attached.

The pair of first wall parts 33 are erected roughly perpendicularly toward an upper side (in a cross direction to the conveying direction) by the same lengths. That is, each first wall part 33 is bent from the end of the attachment part 32 to a side separating from the attachment face 32*a* (the pad 23). Outer faces of the pair of first wall parts 33 become left and right faces of the supporting member 24.

The second sheet metal 31 is longer than the fixing belt 20 in the rotation axis direction, and has roughly the same length of the fixing frame 13*a*, and both ends of the second sheet metal 31 are anchored to the fixing frame 13*a*. The second sheet metal 31 is formed integrally to have a base part 34 as a bottom portion of the U-shape elongated in the conveying direction, a pair of second wall parts 35 bent from both ends of the base part 34, a pair of contact parts 36 bent from respective distal ends of the pair of second wall parts 35, and a pair of reinforcement parts 37 bent from respective distal ends of the pair of contact parts 36. The second sheet metal 31 is located so that the base part 34 is positioned at an upper side, and the base part 34 becomes an upper plate of the supporting member 24 and an upper face of the base part 34 becomes an opposite face to the attachment face 32*a*.

The pair of second wall parts 35 are erected roughly perpendicularly toward a lower side (in a cross direction to the conveying direction) by the same lengths. That is, each second wall part 35 is bent from the end of the base part 34 to a side approaching the attachment face 32*a* (the pad 23). The pair of contact parts 36 are elongated to respective approaching sides each other in the conveying direction by the same lengths and arranged at a predetermined interval. The pair of reinforcement parts 37 are erected roughly perpendicularly toward the upper side (in a cross direction to the conveying direction) by the same lengths. That is, each reinforcement part 37 is bent from the end of each contact part 36 to a side separating from the attachment face 32*a* (the pad 23).

Moreover, the pair of second wall parts 35 respectively have a pair of first locking parts 38 protruded from the outer faces (an outer circumference face of the supporting member 24) at positions on respective end sides from the fixing belt 20 in the rotation axis direction. The base part 34 has second locking parts 39 opened on an outer face (an outer circumference face of the supporting member 24) at positions on respective end sides from the first locking parts 38 in the rotation axis direction. The second locking parts 39 may be formed by opening corner between the base part 34 and the second wall part 35. Incidentally, although the embodiment is described about an example that the second locking parts 39 are formed by opening, the second locking parts 39 may be formed by protruding.

An inner diameter of the first sheet metal 30 in the conveying direction (a length between the pair of first wall parts 33) is roughly equal to or slightly longer than an outer diameter of the second sheet metal 31 in the conveying direction. Thereupon, the second sheet metal 31 is fitted into the first sheet metal 30 while inner faces of the pair of first wall parts 33 are laid along outer faces of the pair of second wall parts 35, and outer faces of the pair of the contact parts 36 are brought into contact with an inner face of the attachment part 32. In such a state, the inner faces of the pair of first wall parts 33 are attached to the outer faces of the pair of second wall parts 35 and the outer faces of the pair of the contact parts 36 are attached to the inner face of the attachment part 32, and thereby, the first sheet metal 30 is attached to the second sheet metal 31. For example, the first sheet metal 30 and the second sheet metal 31 are bonded by laser beam welding or the like. The pair of first wall parts 33 and the pair of second wall parts 35 bonded to each other constitute left and right plates of the supporting member 24. Thereby, the left and right plates of the supporting member 24 are constituted more strongly.

Incidentally, the first sheet metal 30 and the second sheet metal 31 may preferably be bonded in a state that the first sheet metal 30 is arranged so that the pad 23 attached to the attachment face 32*a* of the attachment part 32 takes an approximate position and an approximate direction with respect to the pressuring roller 21, and that the second sheet metal 31 is arranged so as to take an approximate position and an approximate direction with respect to the fixing frame 13*a*.

Figure 6:
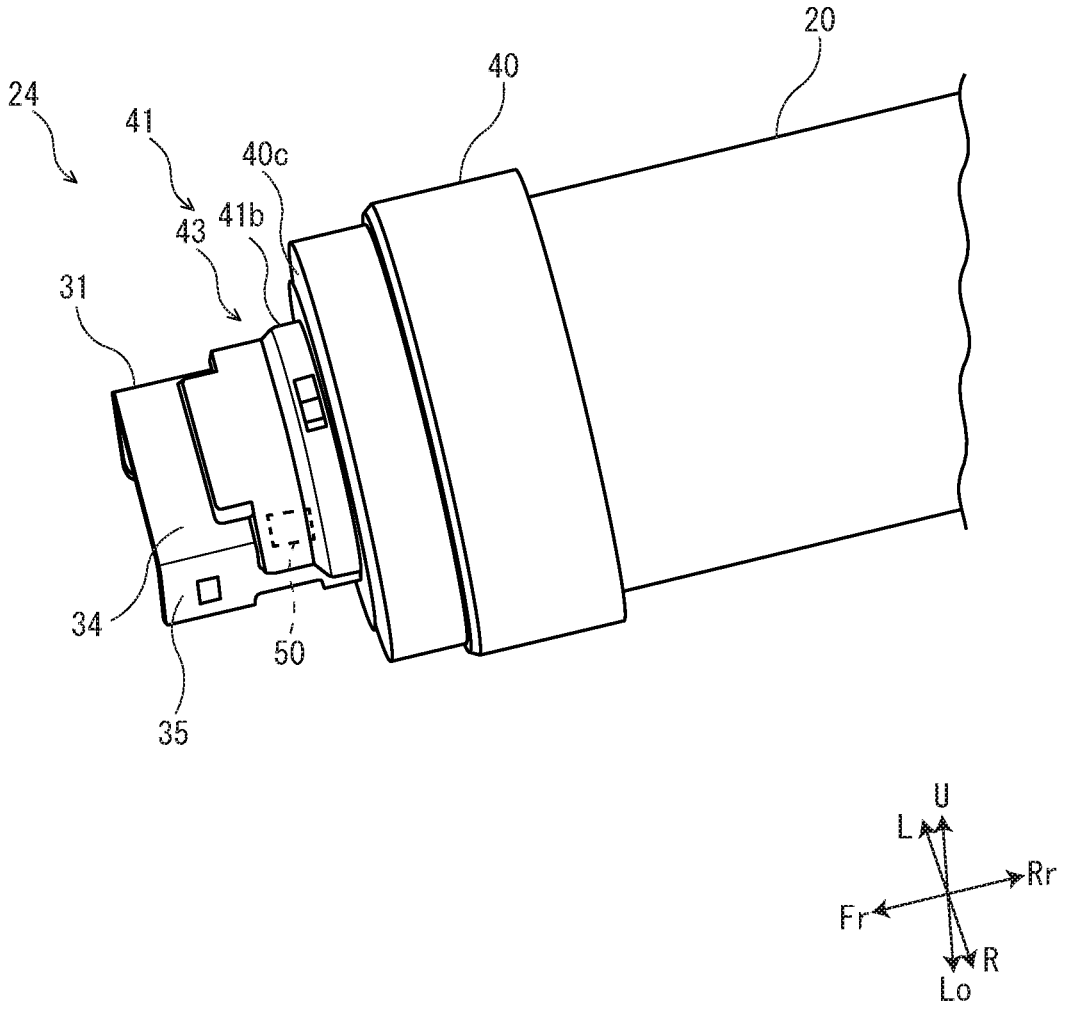
FIG. 6 is a perspective view showing the supporting member, in a state that a fixing belt is attached, in the fixing device according to the embodiment of the present disclosure.

Moreover, to the supporting member 24, as shown in FIG. 6, a pair of caps 40 supporting the fixing belt 20 rotatably and a pair of pivot supporting members 41 respectively pivotally supporting the pair of caps 40 rotatably are attached. Although the respective caps 40 and the respective pivot supporting members 41 are arranged at both ends of the supporting member 24 in the rotation axis direction (the forward and backward directions) of the fixing belt 20, FIG. 6 illustrates only the front cap 40 and the front pivot supporting member 41. The rear cap 40 and the rear pivot supporting member 41 are configures similar to the front cap 40 and the front pivot supporting member 41, and therefore, hereinafter, the front cap 40 and the front pivot supporting member 41 will be described and description of the rear cap 40 and the rear pivot supporting member 41 is omitted.

Figure 9:
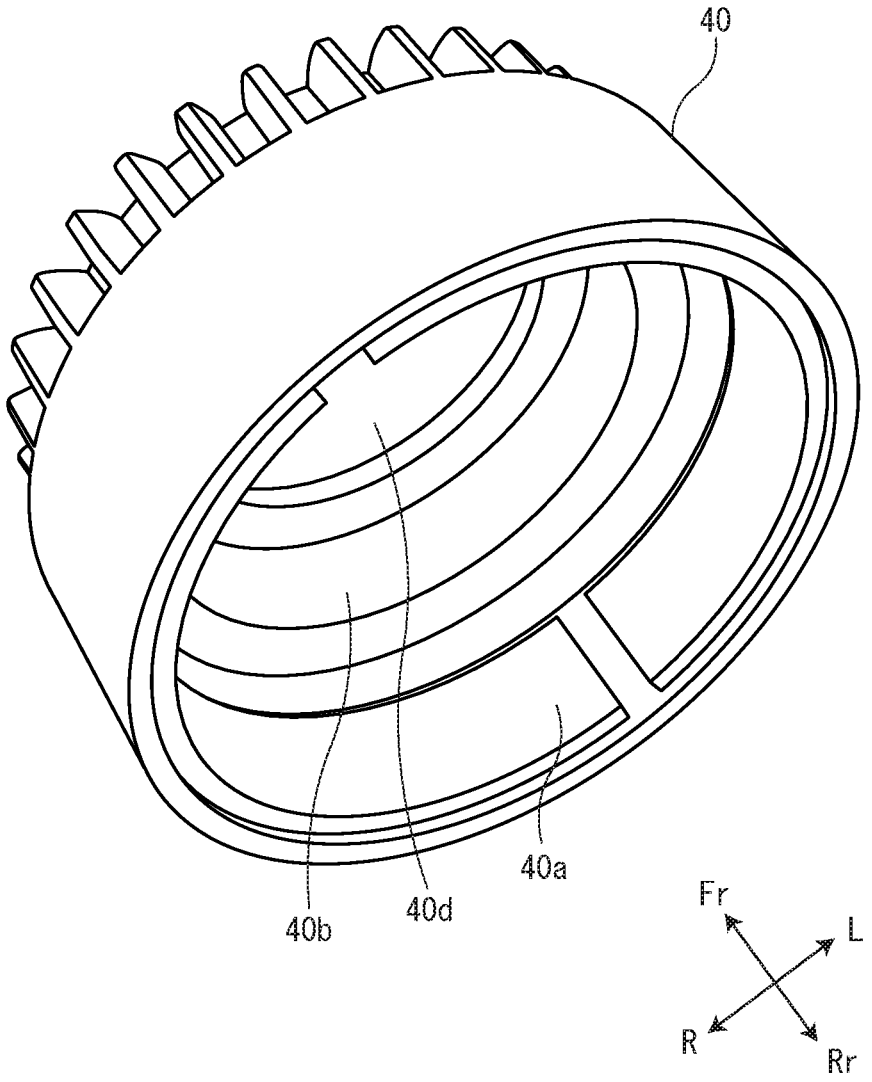
FIG. 9 is a perspective view showing a cap in the fixing device according to the embodiment of the present disclosure.

The cap 40 is formed in a bottomed cylindrical shape and, on an inner circumference of the cap 40, as shown in FIG. 9, a first inner diameter part 40*a* having an inner diameter roughly equal to (or slightly longer than) an outer diameter of the fixing belt 20 and a second inner diameter part 40*b* having an inner diameter smaller than the first inner diameter part 40*a* are provided. In a state that a bottom portion 40*c* of the cap 40 is directed to an end side in the rotation axis direction, an end of the fixing belt 20 is fitted into the first inner diameter part 40*a* of the cap 40, and thereby, the cap 40 is attached to the fixing belt 20.

Figure 7:
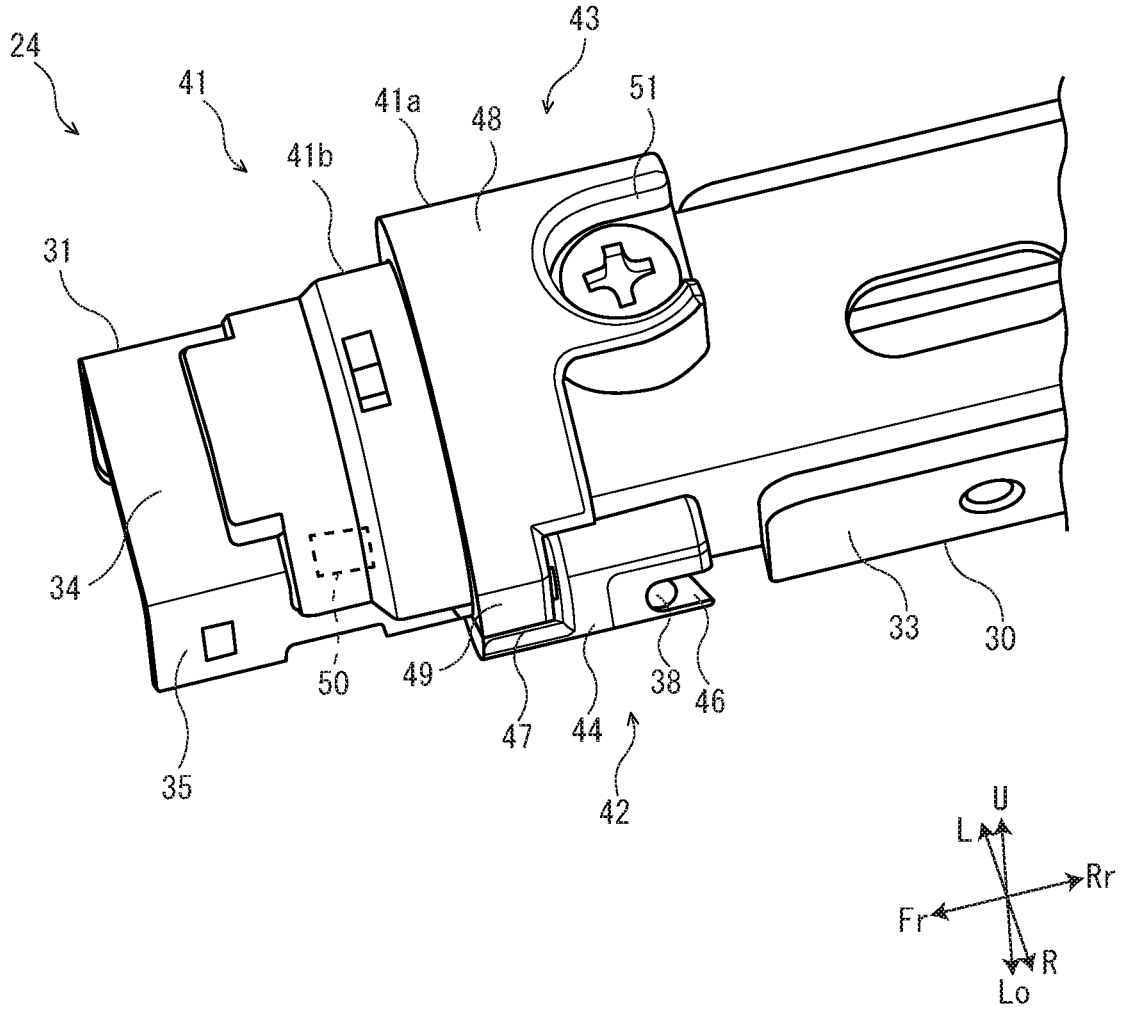
FIG. 7 is a perspective view showing the supporting member, in a state that a pivot supporting member is attached, in the fixing device according to the embodiment of the present disclosure.

The pivot supporting member 41 is configured, as shown in FIG. 7, in a roughly cylindrical shape by combining individual components of a positioning member 42 and a fastening member 43 to have an inner circumference shape along an outer circumference shape of the second sheet metal 31 of the supporting member 24. The pivot supporting member 41 is fitted outside the second sheet metal 31 along an outer circumference face of the second sheet metal 31 from the end side in the rotation axis direction. Details of the positioning member 42 and the fastening member 43 will be described later.

In the pivot supporting member 41, a first outer diameter part 41*a* having an outer diameter roughly equal to (or slightly smaller than) the inner diameter of the second inner diameter part 40*b* of the cap 40 and a second outer diameter part 41*b* having an outer diameter smaller than the first outer diameter part 41*a* are provided. The first outer diameter part 41*a* is formed in a cylindrical shape and the second outer diameter part 41*b* is formed to have an arched cross section and to continue from an upper portion of the first outer diameter part 41*a* toward the end side in the rotation axis direction. Incidentally, the second outer diameter part 41*b* may be formed in a cylindrical shape continuing from the first outer diameter part 41*a*.

In a bottom portion 40*c* of the cap 40, an insertion hole 40*d* is provided (refer to FIG. 9) and the insertion hole 40*d* is formed to have an inner diameter larger than the outer diameter of the second outer diameter part 41*b* of the pivot supporting member 41 and smaller than the outer diameter of the first outer diameter part 41*a*. In the insertion hole 40*d*, the supporting member 24 and the second outer diameter part 41*b* of the pivot supporting member 41 are inserted. At this time, an inner face of the bottom portion 40*c* of the cap 40 comes into contact with the first outer diameter part 41*a* of the pivot supporting member 41, and thereby, movement of the cap 40 to the end side in the rotation axis direction is restricted.

The second inner diameter part 40*b* of the cap 40 has the inner diameter roughly equal to (slightly longer than) the outer diameter of the first outer diameter part 41*a* of the pivot supporting member 41, and when the first outer diameter part 41*a* is fitted into the second inner diameter part 40*b*, the cap 40 is pivotally supported to the pivot supporting member 41. In other words, the fixing belt 20 is rotatably supported by the cap 40.

The positioning member 42 and the fastening member 43 of the pivot supporting member 41 will be described. The positioning member 42 is a member for positioning the pivot supporting member 41 with respect to the supporting member 24 in the rotation axis direction and a circumference direction of the fixing belt 20. The fastening member 43 is a member for fastening the pivot supporting member 41 with respect to the supporting member 24.

Figure 8:
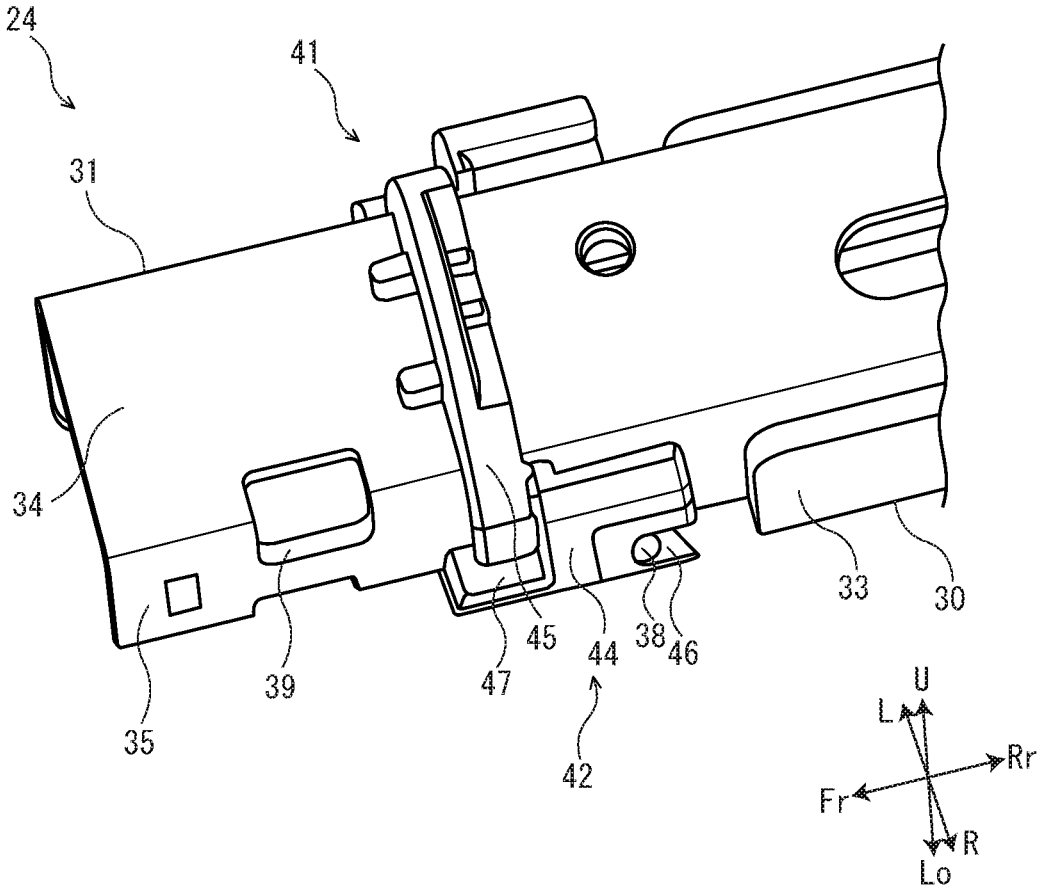
FIG. 8 is a perspective view showing the supporting member, in a state that a positioning member is attached, in the fixing device according to the embodiment of the present disclosure.
Figure 10:
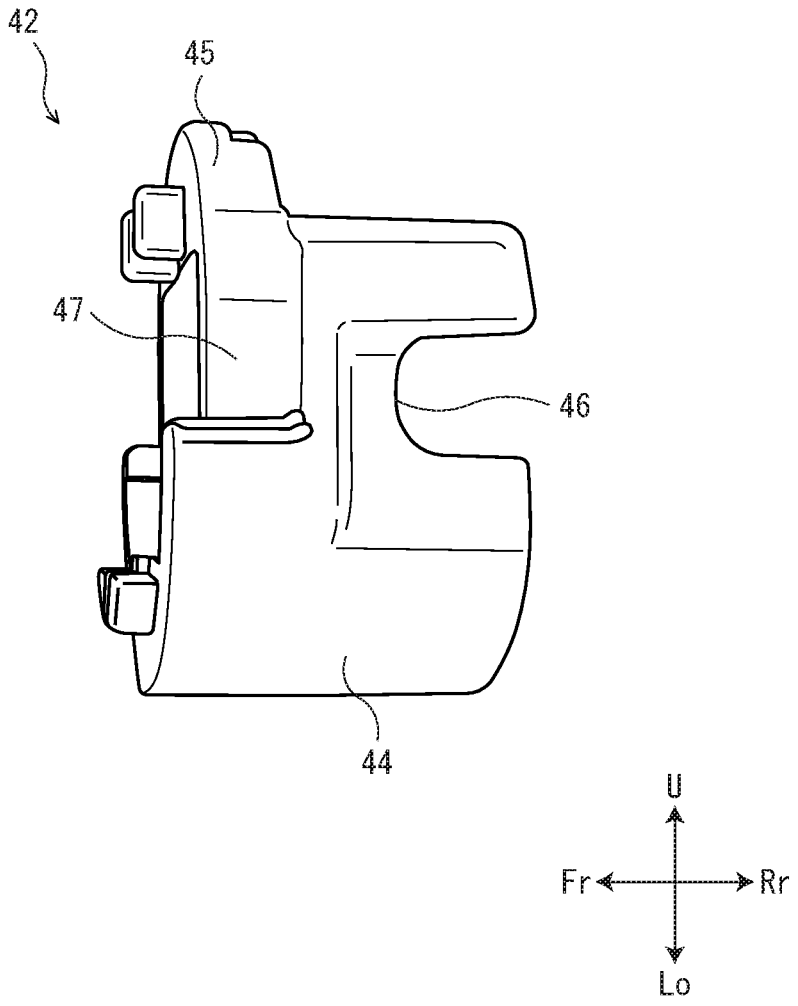
FIG. 10 is a perspective view showing the positioning member in the fixing device according to the embodiment of the present disclosure.

The positioning member 42 is formed integrally, as shown in FIGS. 8 and 10, to have a cylinder lower half part 44 having an arched cross section and constituting a lower portion of the first outer diameter part 41*a* of the pivot supporting member 41, and a bridge part 45 bridged on the cylinder lower half part 44 at the end side in the rotation axis direction. The bridge part 45 constitutes a ring-like shape together with the cylinder lower half part 44 in order to make the positioning member 42 fit along the outer circumference face of the second sheet metal 31 of the supporting member 24.

An external shape of the cylinder lower half part 44 corresponds to an external shape of the lower portion of the first outer diameter part 41*a*, and the cylinder lower half part 44 has an inner circumference shape along an outer circumference shape of the lower portion of the second sheet metal 31 of the supporting member 24. The cylinder lower half part 44 has a pair of lateral walls elongated to an upper side, and is formed so that the pair of lateral walls are elongated to upper ends of the pair of second wall parts 35 of the second sheet metal 31 in a state that the positioning member 42 is fitted into the second sheet metal 31 (refer to FIG. 8).

On the pair of lateral walls of the cylinder lower half part 44, a pair of first locked part 46 are respectively recessed at a center side in the rotation axis direction. When the positioning member 42 fitted on the second sheet metal 31 is moved to the center side in the rotation axis direction, the pair of first locking part 38 arranged on the pair of second wall parts 35 are respectively fitted into the first locked part 46, and thereby, each first locked part 46 is locked to each first locking part 38. Thereby, the positioning member 42 is locked to the supporting member 24 at the center side in the rotation axis direction and positioned with respect to the supporting member 24 in the rotation axis direction and the circumference direction.

On outer faces of the pair of lateral walls of the cylinder lower half part 44, a pair of engaged part 47 are respectively recessed at an upper end side and the end side in the rotation axis direction. The pair of engaged part 47 are formed in a stair shape in the rotation axis direction.

The bridge part 45 is bridged so as to continue from upper ends of bottom portions of the pair of engaged part 47. That is, the bridge part 45 and the bottom portions of the pair of engaged part 47 are formed with an outer diameter smaller than an outer diameter of the cylinder lower half part 44 (the first outer diameter part 41*a*). The bridge part 45 has an inner circumference shape along an outer circumference shape of an upper portion of the second sheet metal 31 of the supporting member 24.

Figure 11:
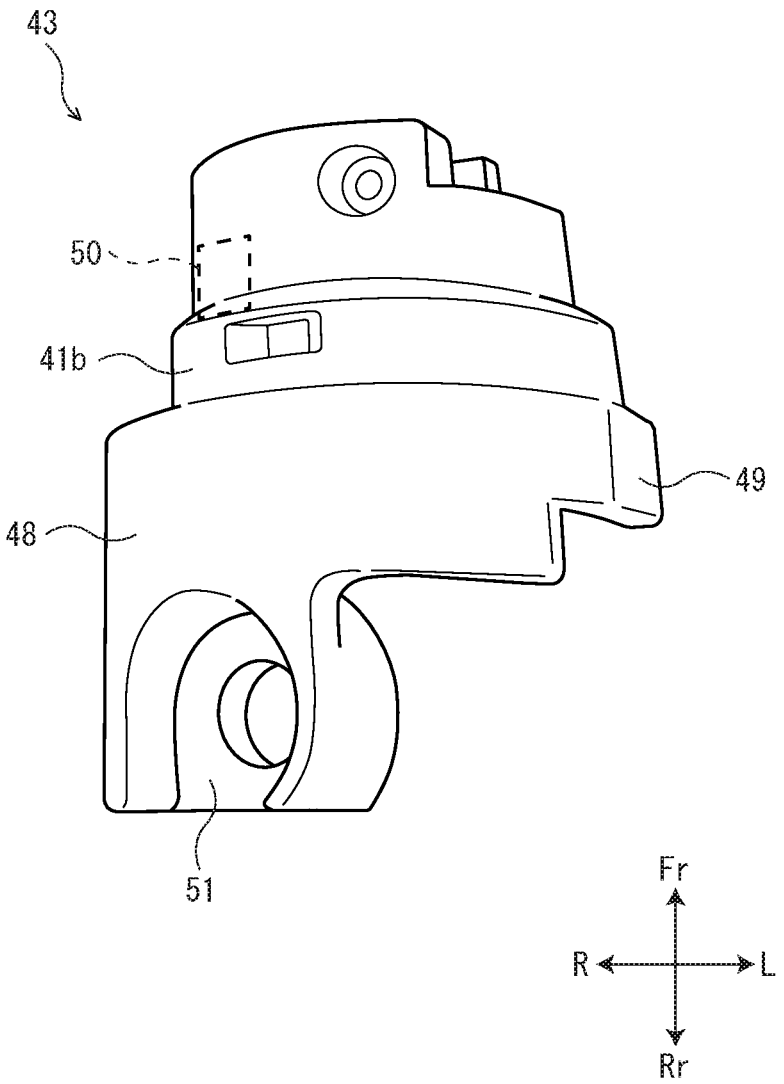
FIG. 11 is a perspective view showing a fastened member in the fixing device according to the embodiment of the present disclosure.

The fastening member 43 is formed, as shown in FIGS. 7 and 11, to have a roughly arched cross section, has a cylinder upper half part 48 having an arched cross section and constituting an upper portion of the first outer diameter part 41*a* of the pivot supporting member 41, and is attached to the second sheet metal 31 of the supporting member 24 from an upper side at a position corresponding to the positioning member 42. In the fastening member 43, the second outer diameter part 41*b* is formed so as to continue from the cylinder upper half part 48 to the end side in the rotation axis direction.

As shown in FIG. 7, the cylinder upper half part 48 constitutes the first outer diameter part 41*a* of the pivot supporting member 41 together with the cylinder lower half part 44 of the positioning member 42. The cylinder upper half part 48 has an inner circumference shape along an outer circumference shape of an upper portion of the second sheet metal 31 of the supporting member 24. Both ends of the cylinder upper half part 48 are elongated to upper ends of the pair of second wall parts 35 of the second sheet metal 31 in a state that the fastening member 43 is attached to the second sheet metal 31 (refer to FIG. 7). In both ends of the cylinder upper half part 48, a pair of engaging parts 49 protruded to a lower side are formed at the end side in the rotation axis direction.

The pair of engaging parts 49 are formed in a stair shape in the rotation axis direction. When the fastening member 43 is attached to the second sheet metal 31 on which the cylinder lower half part 44 is fitted, the pair of engaging parts 49 of the cylinder upper half part 48 are engaged to the pair of engaged part 47 of the cylinder lower half part 44 from the end side in the rotation axis direction. Thereby, movement of the positioning member 42 to the end side in the rotation axis direction is restricted. Incidentally, since the pair of engaging parts 49 and the pair of engaged part 47 are combined by matching the respective stair shapes to each other, the pair of engaging parts 49 and the pair of engaged part 47 are engaged not only in the rotation axis direction but also in the circumference direction.

On an inner face of the second outer diameter part 41*b* formed in the fastening member 43, a second locked part 50 is formed to protrude to a lower side (in a cross direction to the rotation axis direction). The second locked part 50 is arranged at a position corresponding to the second locking part 39 provided in the base part 34 of the second sheet metal 31 in a state that the fastening member 43 is attached to the second sheet metal 31 (refer to FIG. 7). When the fastening member 43 is attached to the second sheet metal 31, the second locked part 50 is fitted into the second locking part 39 and locked. Thereby, the fastening member 43 is locked with respect to the supporting member 24 in the rotation axis direction and the circumference direction and locked.

Moreover, in a center portion of the cylinder upper half part 48, a fastened part 51 is provided at a center side in the rotation axis direction by being opened. The fastened part 51 of the cylinder upper half part 48 is located so as to correspond to a screw hole provided on an upper face of the second sheet metal 31 in a state that the fastening member 43 is attached to the second sheet metal 31 (refer to FIG. 7). When a screw is fastened to the screw hole of the second sheet metal 31 via the fastened part 51, the fastening member 43 is fastened to the second sheet metal 31, and thereby, the pivot supporting member 41 is fastened to the supporting member 24.

Incidentally, the pivot supporting member 41 may be configured that a protrusion is provided on the bridge part 45 of the positioning member 42 and a recessed portion is provided on an inner face of the fastening member 43, and then, when the positioning member 42 and the fastening member 43 are combined, the protrusion of the bridge part 45 is fitted into the recessed portion of the fastening member 43. Thereby, combination of the positioning member 42 and the fastening member 43 becomes stronger.

In accordance with the embodiment, as described above, the fixing device 13 of the printer 1 (the image forming apparatus) includes the rotatable fixing belt 20, the rotatable pressuring roller 21 (pressuring member), the supporting member 24, the pad 23 (nip forming member), the cap 40 and the pivot supporting member 41. The fixing belt 20 heats the toner image formed on the sheet. The pressuring roller 21 is pressured to the fixing belt 20 to pressure the sheet passing between the fixing belt 20 and the pressuring roller 21. The supporting member 24 is arranged inside the fixing belt 20 to support the fixing belt 20 rotatably. The pad 23 is attached to the supporting member 24 inside the fixing belt 20 to form the fixing nip N between the fixing belt 20 and the pressuring roller 21 by sandwiching the fixing belt 20 together with the pressuring roller 21. The cap 40 supports the end in the rotation axis direction of the fixing belt 20. The pivot supporting member 41 is attached at the end of the supporting member 24 in the rotation axis direction to have the outer circumference face along the inner circumference face of the cap 40 and to pivotally support the cap 40 rotatably. The pivot supporting member 41 includes the positioning member 42 and the fastening member 43. The positioning member 42 is fitted on the supporting member 24 along the outer circumference face of the supporting member 24 from the end side in the rotation axis direction, and locked to the supporting member 24 at the center side in the rotation axis direction. The fastening member 43 is fitted on the supporting member 24 and the positioning member 42, and fastened to the supporting member 24. The positioning member 42 and the fastening member 43 constitute the outer circumference face of the pivot supporting member 41 along the inner circumference face of the cap 40 in a state that the positioning member 42 and the fastening member 43 are fitted to each other.

According to such a configuration, since the pivot supporting member 41 for the fixing belt 20 is constituted by combining individual components of the positioning member 42 and the fastening member 43, it is possible to diversify the pivot supporting member 41 in accordance with the supporting member 24. Moreover, since the supporting member 24 can be provided without depending on a configuration of the pivot supporting member 41, it is possible to restrain unnecessary processing and to improve strength and accuracy of the supporting member 24.

For example, preferably, the supporting member 24 has the first locking part 38 protruded from the outer circumference face of the supporting member 24, and the positioning member 42 has the first locked part 46 recessed at the center side in the rotation axis direction on the positioning member 42 and locked to the first locking part 38. Thereby, by a simple manner locking the first locked part 46 with the first locking part 38, it is possible to position the positioning member 42, and accordingly, to position the pivot supporting member 41 in the rotation axis direction and the circumference direction.

In addition, for example, preferably, the supporting member 24 has the second locking part 39 opened or recessed on the outer circumference face of the supporting member 24, and the fastening member 43 has the second locked part 50 protruded in the cross direction to the rotation axis direction and locked to the second locking part 39. Thereby, by a simple manner locking the second locked part 50 with the second locking part 39, it is possible to position the fastening member 43, and accordingly, to position the pivot supporting member 41 in the rotation axis direction and the circumference direction.

Further, in accordance with the embodiment, in the fixing device 13, the supporting member 24 includes the first sheet metal 30 having the attachment part 32 constituting the attachment face 32*a* on which the pad 23 is attached, and the second sheet metal 31, to which the first sheet metal 30 is attached, anchored to the fixing frame 13*a*. The first sheet metal 30 includes the pair of first wall parts 33 bent from both ends of the attachment part 32 to the side separating from the pad 23. The second sheet metal 31 includes the base part 34 constituting the opposite face to the attachment face 32*a*, the pair of second wall parts 35 bent from both ends of the base part 34 to the side approaching the attachment part 32, the pair of contact parts 36 bent from respective distal ends of the pair of second wall parts 35 to respective approaching sides each other, and the pair of reinforcement parts 37 bent from respective distal ends of the pair of contact parts 36 to the side separating from the attachment part 32. The inner faces of the pair of first wall parts 33 are respectively attached to the outer faces of the pair of second wall parts 35, and the inner face of the attachment part 32 is attached to the outer faces of the pair of contact parts 36, and thereby, the first sheet metal 30 is attached to the second sheet metal 31.

Thereby, since the supporting member 24 is configured by combining individual components of the first sheet metal 30 and the second sheet metal 31, it is possible to improve strength and accuracy of the supporting member 24 without enlarging a configuration attaching the supporting member 24 to the fixing frame 13*a*. Particularly, the second sheet metal 31 attached to the fixing frame 13*a* is formed to have plural bending portions, and thereby, it is possible to improve strength of the second sheet metal 31. On the other hand, the first sheet metal 30, to which the pad 23 is attached, is formed to minimize the number of bending portions, and thereby, it is possible to maintain excellent attachment accuracy of the pad 23. Thus, it is possible to simultaneously improve strength and accuracy of the supporting member 24.

For example, preferably, the pivot supporting member 41 may be attached to the second sheet metal 31 of the supporting member 24. Thereby, since the second sheet metal 31 is located inside the first sheet metal 30, it is possible to minimize a size of the second sheet metal 31 regardless of the pad 23. Therefore, it is possible to restrain an attachment space of the supporting member 24 to the fixing frame 13*a*, and to restrain dependence of the supporting member 24 on sizes of other components located around the supporting member 24.

Incidentally, although, in the embodiment, an example of the heat source 22 composed of the IH unit and arranged outside the fixing belt 20 was described, the present disclosure is not restricted by this example. For example, in another embodiment, the heat source 22 may be composed of a halogen heater or a ceramic heater and arranged outside or inside the fixing belt 20.

The embodiment was described in a case of applying the configuration of the present disclosure to the monochrome printer 1. On the other hand, in another embodiment, the configuration of the disclosure may be applied to another image forming apparatus, such as a color printer, a copying machine, a facsimile or a multifunction peripheral.

The above-description of the embodiment of the present disclosure was described about a preferable embodiment of the fixing device and the image forming apparatus according to the disclosure. However, the technical scope of the present disclosure is not limited to the embodiments.

The invention claimed is:

1. A fixing device comprising:

a rotatable fixing belt heating a toner image formed on a sheet;

a rotatable pressuring member pressured to the fixing belt to pressure the sheet passing between the fixing belt and the pressuring member;

a supporting member arranged inside the fixing belt to support the fixing belt rotatably;

a nip forming member attached to the supporting member inside the fixing belt to form a fixing nip between the fixing belt and the pressuring member by sandwiching the fixing belt together with the pressuring member;

a cap supporting an end in a rotation axis direction of the fixing belt; and a pivot supporting member attached at an end of the supporting member in the rotation axis direction to have an outer circumference face along an inner circumference face of the cap and to pivotally support the cap rotatably, wherein the pivot supporting member includes:

a positioning member fitted on the supporting member along an outer circumference face of the supporting member from an end side in the rotation axis direction and locked to the supporting member at a center side in the rotation axis direction; and a fastening member fitted on the supporting member and the positioning member and fastened to the supporting member, the supporting member has a first locking part protruded from the outer circumference face of the supporting member, the positioning member has a first locked part recessed at the center side in the rotation axis direction on the positioning member and locked to the first locking part, and the positioning member and the fastening member constitute the outer circumference face of the pivot supporting member along the inner circumference face of the cap in a state that the positioning member and the fastening member are fitted to each other.

2. The fixing device according to claim 1, wherein the supporting member has a second locking part opened or recessed on the outer circumference face of the supporting member, the fastening member has a second locked part protruded in a cross direction to the rotation axis direction and locked to the second locking part.

3. The fixing device according to claim 1, wherein the supporting member includes:

a first sheet metal having an attachment part constituting an attachment face on which the nip forming member is attached; and a second sheet metal, to which the first sheet metal is attached, anchored to a fixing frame, the first sheet metal includes a pair of first wall parts bent from both ends of the attachment part to a side separating from the nip forming member;

the second sheet metal includes:

a base part constituting an opposite face to the attachment face;

a pair of second wall parts bent from both ends of the base part to a side approaching the attachment part;

a pair of contact parts bent from respective distal ends of the pair of second wall parts to respective approaching sides each other; and a pair of reinforcement parts bent from respective distal ends of the pair of contact parts to a side separating from the attachment part, inner faces of the pair of first wall parts are respectively attached to outer faces of the pair of second wall parts, and an inner face of the attachment part is attached to outer faces of the pair of contact parts, and thereby, the first sheet metal is attached to the second sheet metal.

4. The fixing device according to claim 3, wherein the pivot supporting member is attached to the second sheet metal of the supporting member.

5. An image forming apparatus comprising the fixing device according to claim 1.

6. An image forming apparatus comprising the fixing device according to claim 2.

7. An image forming apparatus comprising the fixing device according to claim 3.

8. An image forming apparatus comprising the fixing device according to claim 4.

9. A fixing device comprising:

a rotatable fixing belt heating a toner image formed on a sheet;

a rotatable pressuring member pressured to the fixing belt to pressure the sheet passing between the fixing belt and the pressuring member;

a supporting member arranged inside the fixing belt to support the fixing belt rotatably;

a nip forming member attached to the supporting member inside the fixing belt to form a fixing nip between the fixing belt and the pressuring member by sandwiching the fixing belt together with the pressuring member;

a cap supporting an end in a rotation axis direction of the fixing belt; and a pivot supporting member attached at an end of the supporting member in the rotation axis direction to have an outer circumference face along an inner circumference face of the cap and to pivotally support the cap rotatably, wherein the pivot supporting member includes:

a positioning member fitted on the supporting member along an outer circumference face of the supporting member from an end side in the rotation axis direction and locked to the supporting member at a center side in the rotation axis direction; and a fastening member fitted on the supporting member and the positioning member and fastened to the supporting member, the positioning member and the fastening member constitute the outer circumference face of the pivot supporting member along the inner circumference face of the cap in a state that the positioning member and the fastening member are fitted to each other, the pivot supporting member has a first outer diameter part having an outer diameter roughly equal to an inner diameter of the cap, and a second outer diameter part having an outer diameter smaller than the first outer diameter part, the cap has an insertion hole at an end side in the rotation axis direction, and the second outer diameter part is inserted into the insertion hole.

10. The fixing device according to claim 9, wherein the positioning member has a cylinder lower half part having an arched cross section and constituting a lower portion of the first outer diameter part, and a bridge part bridged on the cylinder lower half part, the supporting member is fitted into a ring-like shape composed of the cylinder lower half part and the bridge part.

11. The fixing device according to claim 10, wherein on an outer face of the cylinder lower half part, a engaged part is recessed at an end side in the rotation axis direction, the fastening member has a cylinder upper half part having an arched cross section and constituting an upper portion of the first outer diameter part, the cylinder upper half part has an engaging part engaging to the engaged part.

12. An image forming apparatus comprising the fixing device according to claim 9.

13. An image forming apparatus comprising the fixing device according to claim 10.

14. An image forming apparatus comprising the fixing device according to claim 11.

15. A fixing device comprising:

a rotatable fixing belt heating a toner image formed on a sheet;

a rotatable pressuring member pressured to the fixing belt to pressure the sheet passing between the fixing belt and the pressuring member;

a supporting member arranged inside the fixing belt to support the fixing belt rotatably;

a nip forming member attached to the supporting member inside the fixing belt to form a fixing nip between the fixing belt and the pressuring member by sandwiching the fixing belt together with the pressuring member;

a cap supporting an end in a rotation axis direction of the fixing belt; and a pivot supporting member attached at an end of the supporting member in the rotation axis direction to have an outer circumference face along an inner circumference face of the cap and to pivotally support the cap rotatably, wherein the pivot supporting member includes:

a positioning member fitted on the supporting member along an outer circumference face of the supporting member from an end side in the rotation axis direction and locked to the supporting member at a center side in the rotation axis direction; and a fastening member fitted on the supporting member and the positioning member and fastened to the supporting member, the supporting member has a locking part opened or recessed on the outer circumference face of the supporting member, the fastening member has a locked part protruded in a cross direction to the rotation axis direction and locked to the locking part, and the positioning member and the fastening member constitute the outer circumference face of the pivot supporting member along the inner circumference face of the cap in a state that the positioning member and the fastening member are fitted to each other.

16. An image forming apparatus comprising the fixing device according to claim 15.

* * * * *